United States Patent [19]

Gansel et al.

[11] Patent Number: 4,564,181

[45] Date of Patent: Jan. 14, 1986

[54] BENCH

[75] Inventors: Eduard Gansel, Dettenhausen; Günter Schaal, Stuttgart; Helmut Schneider, Leinfelden-Echterdingen; Heribert Schramm, Stuttgart; Eberhard Seidel, Ostfildern; Günter Zilly, Leinfelden-Echterdingen, all of Fed. Rep. of Germany

[73] Assignee: Robert Bosch GmbH, Stuttgart, Fed. Rep. of Germany

[21] Appl. No.: 513,990

[22] Filed: Jul. 14, 1983

[30] Foreign Application Priority Data

Sep. 10, 1982 [DE] Fed. Rep. of Germany ..... 3233586

[51] Int. Cl.[4] ..... B25B 1/00

[52] U.S. Cl. ..... 269/88; 108/12; 108/78; 108/144; 144/286 R; 269/100; 269/901

[58] Field of Search ..... 144/286 R; 248/166; 269/71, 88, 99, 100, 900, 901; 108/12, 28, 78, 92, 96, 102, 144, 153, 13, 65, 78, 90

[56] References Cited

U.S. PATENT DOCUMENTS

| | | | |
|---|---|---|---|
| 28,382 | 5/1860 | Lamb | 269/236 |
| 350,414 | 10/1886 | Crowley | 108/13 |
| 633,393 | 9/1899 | Shaw | 108/13 |
| 2,113,689 | 4/1938 | Haban | 108/92 |
| 4,415,149 | 11/1983 | Rees | 269/900 |

*Primary Examiner*—Frederick R. Schmidt
*Assistant Examiner*—Judy J. Hartman
*Attorney, Agent, or Firm*—Michael J. Striker

[57] ABSTRACT

A bench includes a rigid frame and a work board pivotable to and away from the frame. The work board can be brought into a rest position and into a plurality of operating positions and can be in at least two operating positions supported by an arm movably supported on the frame. The arm is pivotable with respect to the frame in a horizontal plane. The arm can carry at its free end a clamping device. The structure of the bench increases a range of clamping a work piece on the bench over the length of the work board.

5 Claims, 6 Drawing Figures

BENCH

BACKGROUND OF THE INVENTION

The present invention relates to a bench.

Known benches of the type under consideration are comprised of a rigid carrier structure and a work board pivotable on the carrier structure.

One of such benches is disclosed in German Pat. publication No. P 3106 692.1. In the bench described in this publication the work board is adjustable to various operating positions only when it is clamped between two pivots. Such a clamping in the proximity of bearings is relatively loadable. Therefore the work board has only an actual loadable operating position. This operating position is the position in which the work board can be supported on the rigid carrier frame or on clamping means, such as removable vises, connected to the frame. The disadvantage of known benches is that the work board and the clamping means are never utilized simultaneously under normal loading.

SUMMARY OF THE INVENTION

It is an object of this invention to provide an improved structure of the bench.

It is another object of the invention to provide a bench in which the work board can be utilized in a plurality of pivoted positions for work with normal loading.

This and other objects of the invention are attained by a bench, comprising a rigid carrier frame; a work board pivotably supported on said carrier frame and adapted to be arranged in a rest position and in a plurality of operating positions; and means for supporting said work board, said supporting means being movably supported on said frame to support said work board in a plurality of pivoted positions in respect to said frame.

The work board may have two opposite edge portions, said frame having an upper portion, and wherein pivoting means for pivoting said work board relative to said frame are provided, said pivoting means including two pivot pins each interconnected between said upper portion of the frame and the respective edge portion of said work board whereby said work board can be pivoted about a pivot axis from a first horizontal position in which the work board is disposed above said frame and overlaps the same to a second horizontal position in which the work board projects outwardly away from said frame.

When the work board is in the above mentioned second position the clamping means for clamping a work piece is accessible.

When the work board is in its rest position it remains within the periphery or contour of the assembled bench.

The board-supporting means may include an arm which is supported on the frame to be pivoted in a horizontal plane under the work board.

The rigid frame of the bench may have a region coverable by the work board when the latter is in said first position and released from said work board when the latter is in said second position, the frame in said region carrying at least one means for receiving a detachable means for clamping a work piece. This detachable clamping means may be a vise.

The board-supporting means may further include two support blocks connected to the arm and spaced from each other on the arm, the work board having an underside which lies on at least one of the support blocks when the work board is in said first position.

The supporting arm has one end at which a pivot for pivoting said arm is located and another free end, one of the two support blocks being positioned near the one end and another of said two support blocks being positioned near the free end of the arm.

Due to the mounting of one support block in the proximity of the free end of the arm the pivotable arm can, in addition to its function as a support for the work board, serve as a receiving means for a clamping means for clamping a work piece which is longer than the work board.

The frame may be provided with a plurality of bearing openings formed in said upper portion of the frame, said openings being distributed along said upper portion and adapted to selectively receive said pivot for pivoting said arm in said horizontal plane, said openings being as far as possible remote from the pivot axis of said work board.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
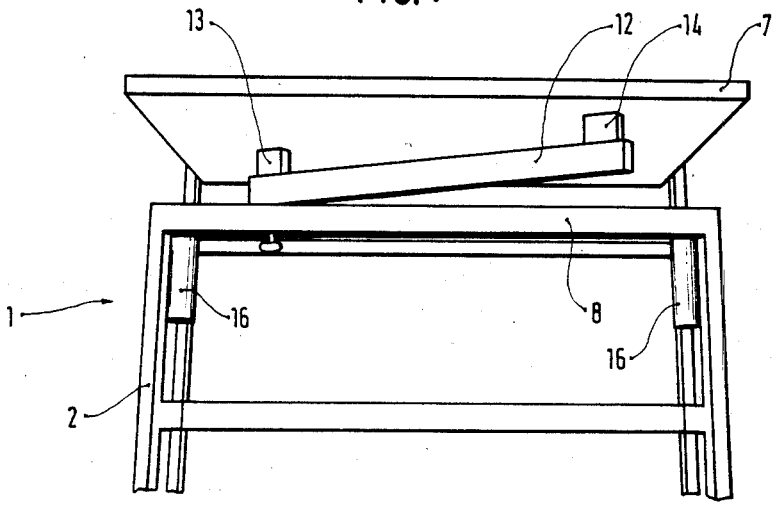
FIG. 1 is a perspective view of the upper part of the bench seen from below and illustrating a work board of the bench a first operation position.
Figure 2:
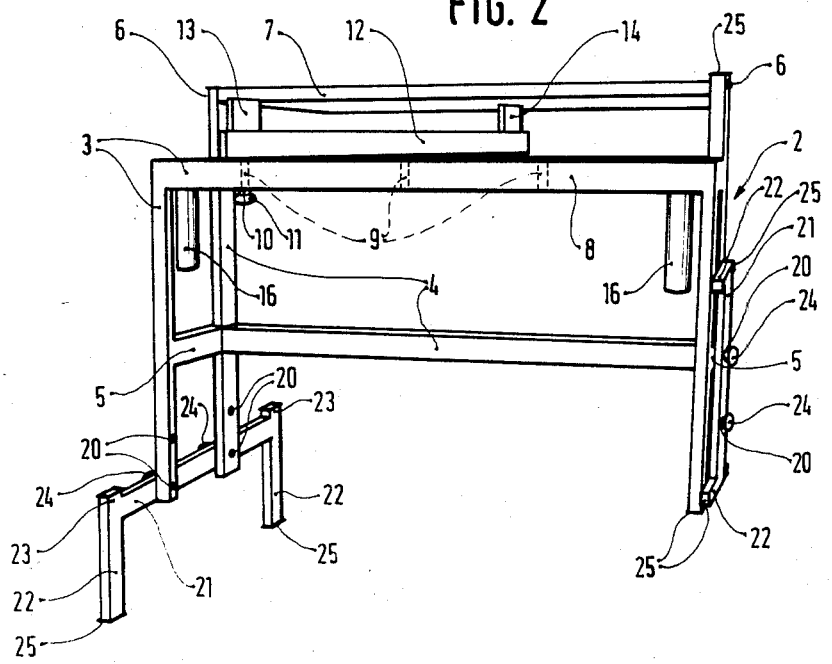
FIG. 2 is a perspective view of the bench according to the invention with the work board in its second operation position and with foot elements attached to the carrier frame of the bench.

Referring now to the drawings, and first to FIGS. 1 and 2 it will be seen that a bench generally designated as 1 includes a rigid carrier structure which is formed as a carrier frame 2. Carrier frame 2 is comprised of two subframes 3 and 4 each formed of square tube material, subframes 3 and 4 being joined to each other by means of a crosspiece 5 also made from square tube material. Vertical tubes of subframe 4 project above vertical tubes of subframe 3. Vertical tubes 40 of subframe 4 are provided at their respective opposite upper end portions with bearing bores which receive pins or pivots 6 which are extended into and secured to a pivotable work board 7. Pivots 6 are located close to the respective opposite edges of work board 7. Work board 7 can be pivoted about pivots 6 from its first operation position shown in FIGS. 1 and 4, in which the work board is located above frame 2, and a second operation position shown in FIGS. 2 and 3, in which the work board is pivoted away from frame 2.

Subframe 3 has an upper horizontal transom 8 which is formed with a number of vertical bearing bores 9 each adapted to receive a pin 10 provided with a head 11. The pin can be inserted in any one of bores 9 with a play and screwed into or otherwise rigidly connected with its upwardly projected end to an arm 12 so that arm 12 can be pivoted about pin 10 in a horizontal plane. Due to the insertion of pin 10 into different holes 9 arm 12 can be displaced along frame 2 and thus support work board 7 in positions. Arm 12 carries at two opposite ends thereof two support blocks 13 and 14 which project upwardly from arm 12. Support block 14 mounted at the free end of arm 12 has a recess 14*a* for receiving a clamping arrangement 15 shown in FIG. 6. Clamping arrangement 15 can be formed of stationary or movable clamping jaws usually known in the art and not described herein in detail.

Figure 3:
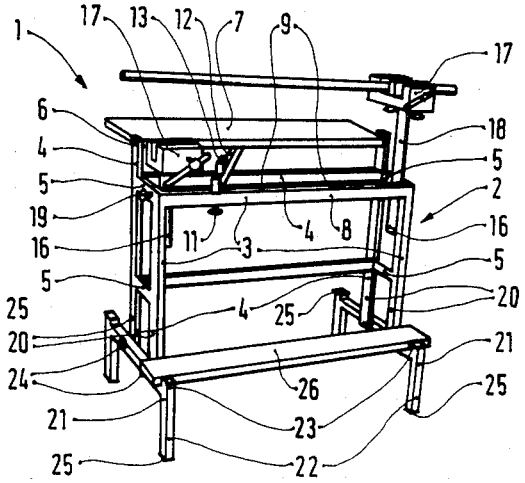
FIG. 3 is a perspective view of the bench seen from above and with the work board in its second operation position and also illustrating a pair of vises mounted to the bench and a foot board.

Tubular elements 16 extended downwardly from transom 8 in the vertical direction are mounted to transom 8 at two opposite ends thereof; tubular elements 16 are each provided for receiving a respective vise 17 shown in FIG. 3. Each vise as seen in FIG. 3 is provided with a respective tubular trunnion 18 received in the assigned tubular element 16. Locking of the trunnions 18 in tubular elements 16 is effected by means of clamping bolts 19 each of which secures the trunnion 18 together with vise 17 in any desired extended position with respect to the tubular element 16.

Figure 4:
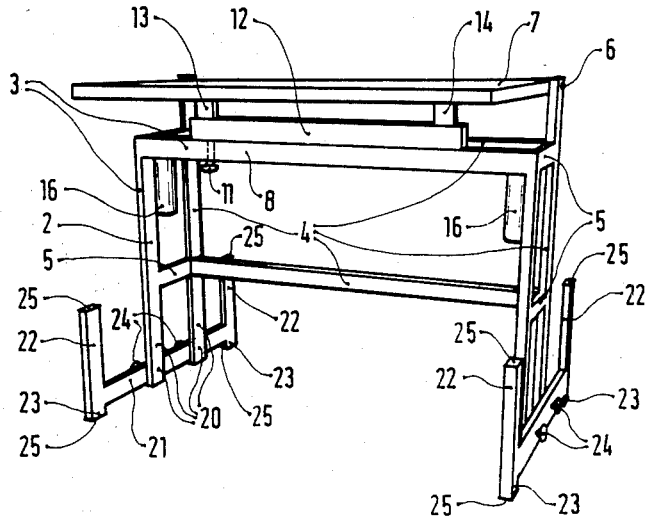
FIG. 4 is a perspective view of the bench according to the invention with the work board in its first operation position and with the foot elements arranged on the carrier frame in the position corresponding to a lower adjustable height of the bench.

Lower ends of subframes 3 and 4 are formed with horizontally extended threaded bores 20. Detachable foot elements 21 can be connected to the lower ends of subframes 3 and 4 by means of bolts 24 extended into respective bores 20. Each foot element 21 is formed of one elongated transverse square tube leg and two vertical square tube legs of a shorter length, all sections of element 21 being welded together to provide a rigid structure. It is to be noted that both shorter square tube legs of each foot element are of the same length; these shorter legs form two pairs of unidirected legs in respect to the elongated transverse leg. It is to be realized that the legs in one pair are shorter than the legs in another pair. With reference to FIGS. 2 and 4 it is seen that each foot element 21 has two longer legs extended from the transverse leg in one direction and two shorter legs 23 extended from the transverse leg in the opposite direction. Depending on the position of the respective pairs of unidirected legs in respect to the floor the height of the bench can be varied. Legs 22 or 23 form suitable feet of the bench. When legs 22 or 23 rest on the floor they form supporting surfaces which constitute the corner points of the bench.

Each foot element 21 is formed with two through openings at the transverse leg thereof, which openings are spaced from each other and correspond to threaded bores 20 provided in the end portions of subframes 3 and 4. Bolts 24 provided with respective heads are inserted into the through openings in the respective foot element 21 and screwed into assigned threaded bores 20. Thus, depending on the mounting of the foot elements 21 with respect to subframes 3 and 4 either longer legs 22 or shorter legs 23 can be directed downwardly to serve as the feet of the bench. In this manner various operating height positions of the work board 7 can be realized. The provision of two horizontal rows of threaded bores 20 will result in two different height positions. It is, of course, understood that with a number of horizontal pairs of bores 20 spaced from each other in the vertical direction any desired intermediate positions of the bench can be achieved. The foot elements 21 with their longer legs directed downwardly can be fastened to the subframes 3 and 4 at the various levels. In order to obtain a lowermost position of the work board 7 foot elements 21 should be so secured to the frame 2 that shorter legs 23 will serve as four feet or four corner points of the bench.

One of the subframes, for example subframe 4, has threaded bores 20 which are spaced from each other a distance which corresponds to the distance between two through bores formed in the foot element 21. Furthermore, the distance of a respective lower threaded bore 20 from the lower end of subframe 4 is somewhat equal to the distance of the through bore in the foot element 21 from the outer edge of the leg closest to the through bore. Thereby, foot elements 21 can be positioned on the frame 2 so that the transverse leg of the foot element will extend along one of the vertical square tubes of subframe 4. The foot element can be secured in such a position to subframe 4 as shown at the right section of FIG. 2. All the dimensions of the legs of the foot elements 21 can be adjusted, depending on desired use of the bench, to the distance between subframes 3 and 4.

All open ends of the square tubes which form frame 2 and foot elements are closed by plugs 25 made of synthetic plastic material. Plugs 25 inserted into open ends of legs 22 and 23 of the foot elements prevent the bench from sliding on the floor.

As shown in FIG. 3 the bench is provided with a foot board 26 the width of which is such that the foot board is disposed between two opposite legs 23 of opposite foot elements and the front edges of vertical tubes of subframe 3. It is understood that the length of foot board 26 is such that it extends from one foot element 21 to another. The elongated transverse legs of foot elements 21 can be provided with suitable recesses or the foot board may be provided with holding straps which would further stabilize the position of the foot board on the frame 2 of the bench.

Figure 6:
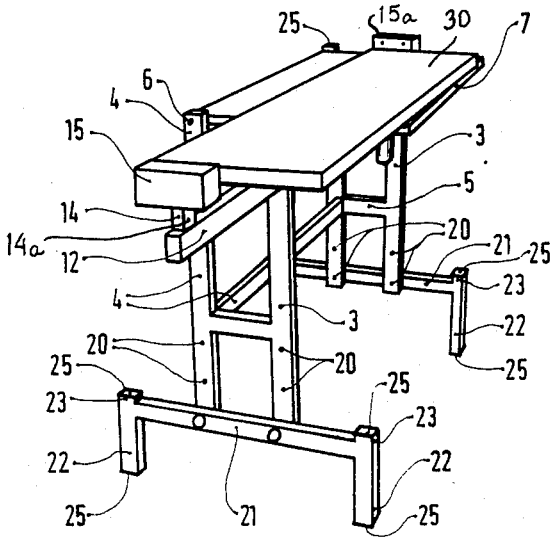
FIG. 6 is a perspective view of the bench according to the invention with the work board in its first operation position and adjusted to the case when a workpiece to be treated is longer than the work board.

Should the work board 7 be utilized in its first operation position shown in FIGS. 1, 4 and 6 the vises 17 are removed from the bench. The work board 7 in this first operation position projects in the horizontal plane over both subframes 3 and 4. Both support blocks 13 and 14 of pivotable arm 12 now support the work board 7. Pivotable arm 12 can in this position be adjusted so as to extend parallel to the upper surface of subframe 3 as shown in FIG. 4. If it is necessary to provide an access to tubular elements 16 for installing the vises 17 thereinto the work board 7 can be pivoted through 180° from its first operation position into its second operation position. Arm 12 then supports work board 7 only with its support block 14.

Figure 5:
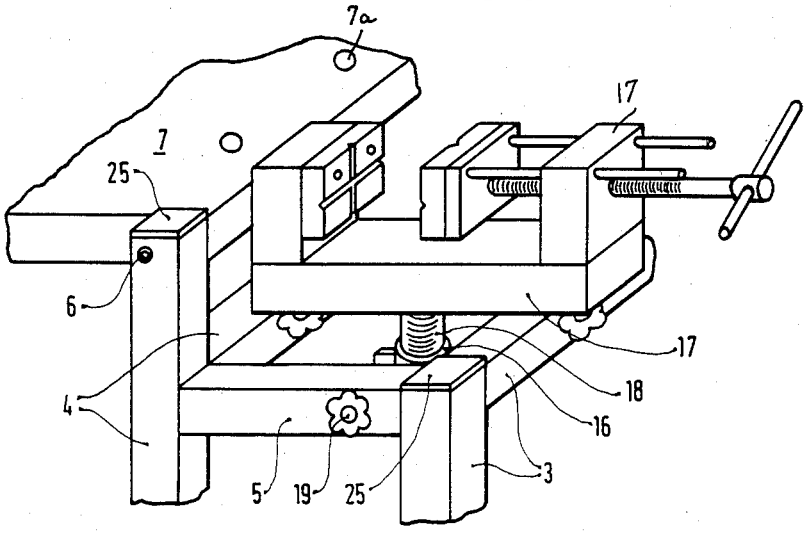
FIG. 5 is a partial perspective view of the bench, illustrating a vise arrangement on the bench, on the enlarged scale.

A further pivoting of the work board 7 into the position behind frame 2 is ensured by pivot points of pivots 6 (FIGS. 2, 3 and 5). As clearly shown in FIG. 3 the rigidly supported work board 7 and two vises 17 are now available for work on the bench. The height position of vises 17 with respect to frame 2 can be varied depending on the extension of trunnions 18 outwardly from tubular elements 16.

FIG. 6 illustrates a specific case of work with the bench, when a work piece 30 to be treated is longer than the work board 7. In this case the work piece is clamped in the bench. Arm 12 is moved in the outward direction so that the free end thereof together with support block 14 projects outwardly from the workboard 7. The clamping device 15 mounted on support block 14 abuts against the edge of the work piece and together with the oppositely positioned clamping member 15*a* clamps the work piece on the work board 7 in the known fashion. It should be noted that the adjustment of the height of the bench and thus the work board by different positioning of the foot elements 21 with respect to the frame 2 is advantageous in this case also because the various thicknesses of the workpieces clamped in clamping device 15 and different working processes can require various respective height positions of the work board. Furthermore, in the above-described special case, the work board 7 remains to be safely supported on the support block 13.

In inoperative condition of the bench 1, arm 12 is pivoted inwardly and lies on the transom 8 of subframe 3. The work board 7 is pivoted downwardly over its second stationary position shown in FIG. 5. Recess 7*a* for receiving clamping elements are provided in the work board 7. Foot element 21 in the position shown at the right section of FIG. 2 is rigidly connected to the bench frame so that no additional room is required therefor.

It will be understood that each of the elements describe above, or two or more together, may also find a useful application in other types of benches differing from the types described above.

While the invention has been illustrated and described as embodied in a bench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bench comprising a rigid carrier frame having an upper portion; a work board having two opposite edge portions; pivoting means for pivoting said work board relative to said frame and including two pivot pins each interconnected between said upper portion of the frame and a respective edge portion of the work board; and supporting means including a supporting arm pivotable about a vertical axis in a horizontal plane under said work board and supporting said work board, said work board being pivotable about a pivot axis on said pivot pins relative to said frame from a first operating horizontal position, in which the work board is disposed immediately above said frame, to a second operating and also horizontal position, in which the work board projects outwardly away from said frame, said supporting arm being movably supported and adjustable relative to said frame so as to support said work board in said first and second horizontal position, said supporting means further including two support blocks connected to said arm and spaced from each other on said arm, said work board having an underside which lies on at least one of said support blocks when the work board is in said first position, said arm having one end at which a pivot for pivoting said arm is located and another free end, one of said two support blocks being positioned near said one end and another of said two support blocks being positioned near said free end of the arm, said frame being provided with a plurality of bearing openings formed in said upper portion of the frame, said openings being distributed along said upper portion and adapted to selectively receive said pivot for pivoting said arm in said horizontal plane, said openings being remote from the pivot axis of said work board.

2. The bench as defined in claim 1, wherein said frame has a portion carrying at least one tubular means for receiving a detachable means for clamping a work piece.

3. The bench as defined in claim 2, wherein said detachable means is a vise.

4. The bench as defined in claim 1, wherein said work board has recesses for receiving clamping elements.

5. The bench as defined in claim 1, wherein another of said blocks has a recess for receiving another clamping means.

* * * * *